US008668133B2

(12) United States Patent
Moehlig et al.

(10) Patent No.: US 8,668,133 B2
(45) Date of Patent: Mar. 11, 2014

(54) RETRACTABLE CONTAINER WITH SUPPORT LEGS

(75) Inventors: Jeremy Moehlig, Cedar Springs, MI (US); Andrew Lapham, Grandville, MI (US); Rick Anthony, Kentwood, MI (US)

(73) Assignee: International Paper Co., Memphis, TN (US)

( * ) Notice: Subject to any disclaimer, the term of this patent is extended or adjusted under 35 U.S.C. 154(b) by 187 days.

(21) Appl. No.: 13/190,711

(22) Filed: Jul. 26, 2011

(65) Prior Publication Data

US 2013/0028702 A1 Jan. 31, 2013

(51) Int. Cl.
*B65D 5/44* (2006.01)
*B65D 19/40* (2006.01)

(52) U.S. Cl.
USPC ..... 229/199; 206/599; 206/600; 248/151; 248/188.8

(58) Field of Classification Search
USPC ..... 229/104, 199; 206/599, 600; 248/151, 248/188.8, 346.01; 312/351.3; 108/33, 38, 108/149, 156
See application file for complete search history.

(56) References Cited

U.S. PATENT DOCUMENTS

| | | | | | |
|---|---|---|---|---|---|
| 2,186,777 | A * | 1/1940 | Best | 229/125.39 |
| 2,534,011 | A * | 12/1950 | De Moine | 229/104 |
| 3,277,627 | A * | 10/1966 | Budd | 53/452 |
| 3,281,049 | A * | 10/1966 | Avitable et al. | 206/599 |
| 3,398,703 | A * | 8/1968 | Mezzano | 108/51.3 |
| 3,451,534 | A * | 6/1969 | Parent et al. | 206/599 |
| 3,831,836 | A * | 8/1974 | Ellison et al. | 229/199 |
| 4,946,042 | A * | 8/1990 | Ferreri et al. | 229/242 |
| 5,462,213 | A * | 10/1995 | Watt | 312/351.3 |
| 5,638,913 | A * | 6/1997 | Blum | 248/188.2 |
| 8,118,375 | B2 * | 2/2012 | Berthiaume et al. | 248/188.8 |
| 2005/0011940 | A1 * | 1/2005 | West | 229/199 |
| 2007/0228132 | A1 * | 10/2007 | Philips et al. | 229/242 |

FOREIGN PATENT DOCUMENTS

| | | | | |
|---|---|---|---|---|
| EP | 80543 | A1 * | 6/1983 | 206/599 |
| FR | 2610899 | A1 * | 8/1988 | 206/600 |
| GB | 2094260 | A * | 9/1982 | 206/599 |

* cited by examiner

*Primary Examiner* — Gary Elkins
(74) *Attorney, Agent, or Firm* — Matthew M Eslami; Dennis H. Lambert

(57) ABSTRACT

A bulk shipping container has a plurality of removable supporting legs extending downwardly from a periphery of its interior space beyond the bottom of the container to support the container in an elevated position above a floor. Reinforcing straps positioned on the container hold the legs in their extended positions. A dolly may be positioned beneath the elevated container between the supporting legs and the reinforcing straps removed to enable the weight of the container to cause it to slide down along the plurality of removable supporting legs to a lowered position resting on the dolly, which may then be used to transport the loaded container into a building for removal of product from the container.

9 Claims, 11 Drawing Sheets

RETRACTABLE CONTAINER WITH SUPPORT LEGS

FIELD OF THE INVENTION

This invention relates generally to shipping containers and particularly to bulk containers for shipping products from a manufacturing or distribution facility to a point where the product is to be used or sold.

BACKGROUND OF THE INVENTION

A variety of products are commonly shipped in large bulk containers from a manufacturing or distribution facility to a point where the product is to be used or sold. Many of these containers are made of corrugated paperboard and may exceed four feet in length and three feet in height, and when filled with product can weigh 400 pounds or more. Handling of such containers is understandably difficult and generally requires the use of a hand jack or forklift or the like to move the filled container.

To facilitate use of a hand jack or forklift and to prevent damage to the container and its contents, it is generally necessary to place the filled container on a pallet for shipping and handling. When the container reaches its destination, a hand jack or pallet or other suitable tool is used to remove the filled container from the transport vehicle and set it down at that location for unpacking or to move it to another location, e.g. into an office or store, for unpacking.

Wheeled dollies are available for moving large objects around, and are frequently used to move large containers from a loading dock, for example, to an interior location where the container is to be unpacked. One type of dolly in common use comprises a simple platform with casters at its corners. To use this dolly, either multiple persons are required in order to lift the filled container onto the dolly, with the attendant risk of injury, or a hand jack or forklift would need to be used to lift the filled container onto the dolly.

Another commercially available dolly is sold by Northern Tool+Equipment under the name Industrial Furniture and Crate Mover. This dolly is in two parts that are engaged with opposite sides of a container and can be used to raise the container up to 11.5 inches and lower it back to the floor. This dolly eliminates the need for use of a hand jack or forklift or for persons to lift the filled. However, it is generally desirable to off-load the transport vehicle, i.e. a truck or the like, quickly and to move product into a building as a steady stream. Consequently, many of these dollies would be needed at each job site, making them cost prohibitive.

Office furniture manufacturers typically use large containers to ship finished goods into environments without using material handling equipment such as hand jacks and forklifts. Containers currently used for this purpose generally have a length of 53 inches, a width of 32 inches, and a height of 35 inches. The 32 inch width allows access through all commercial doors. When the container reaches the site where the finished goods are to be used, the installation company removes all packaging from the container and places the finished goods in an empty container sitting on a "skateboard dolly". The repackaged container resting on the dolly is then moved into the office or other facility, where the goods are again unpackaged. The repacking and unpacking steps increase the labor and cost associated with delivery of the goods to the desired site.

Further, manufacturers of tool boxes, for example, typically ship the tool boxes on wood pallets, and retailers are required to lift or slide the tool boxes off of the pallets. This exposes personnel to injury and exposes the retailer to worker's compensation and liability issues.

Some products, including rugs, are commonly placed on a pallet and shipped to a retail establishment. The doors leading from the receiving dock to the store are 36 inch wide commercial doors. In accordance with current practice, store personnel remove the product from the pallet one item at a time and transport each item from the dock to the store shelf.

Applicant is not aware of any corrugated design or concept that eliminates the need for a pallet and/or material handling equipment, that is sized to fit through all commercial service doors, and that when opened automatically lowers to the floor for easy unpacking or to a dolly for quick transport into a building.

Accordingly, there is need for a bulk container that does not require the use of a pallet or material handling equipment during shipping or for moving the container from a transport vehicle into a building, that is constructed so that a dolly can be positioned beneath it without first lifting it, that lowers automatically to the floor or to a dolly when it is opened, and that can go directly into a building without unpacking it, thereby eliminating the repacking step or the need to unpack the container and carry individual items into a building.

SUMMARY OF THE INVENTION

The present invention is a bulk shipping container that does not require the use of a pallet or material handling equipment during shipping or for moving the container from a transport vehicle into a building. The container is constructed so that a dolly can be positioned beneath it without first lifting it and lowers it to the floor or to a dolly when it is opened, and that can go directly into a building without unpacking it, thereby eliminating the repacking step or the need to unpack the container and carry individual items into a building.

The present invention accomplishes this by providing a bulk corrugated container that has a plurality of removable supporting legs in its corners that extend through the bottom of the container and support the container above the floor when the top of the container is closed, and when the top of the container is opened, the container slides down the supporting legs to lower to the floor or to a dolly positioned beneath the container More specifically, an opening is formed through the bottom wall of the container in each corner, and inwardly folded guide tabs are formed in the sidewalls near the top of the container at each corner, with a support leg extended through each guide tab and opening so that the legs project below the bottom of the container to support the container above the floor or other surface. Container top flaps are folded inwardly over the top of the container and over the upper ends of the legs to hold them in their downwardly extended positions. Straps are applied around the container at the locations of the legs to reinforce the top and prevent the container from sliding down the legs. When it is desired to lower the container onto the floor or onto a dolly, it is necessary only to cut the straps, whereupon the weight of the filled container will cause the legs to push up through the top, automatically lowering the container.

In a specific example of the invention, the container can hold 350 pounds, has a width no greater than 32 inches so that it will fit through standard 36 inch wide commercial doors, and the legs extend nine inches below the container to support it off the ground so that a variety of different dollies can be positioned beneath it. In a preferred construction the container is made of corrugated paperboard and the legs comprise tubes made of fiberboard, although the principles of the invention could be applied to containers made of other materials. For example, the container could be made of paper material, wood, fiberboard, plastic, metal, or other material, and the legs could be made of paper, wood, plastic, metal, or other suitable material. The container is sufficiently rugged to withstand the rigors of moving through a supply chain of truck load and less than truck load.

In use, the operator closes the bottom of the container and sets it on a raised platform that supports the bottom. A worker then slides a tube down through each guide tab and hole. The tubes are longer than the height of the carton so that they protrude from the bottom a predetermined distance. The container is loaded with finished product, the top minor and major flaps are closed, and straps are applied around the container so that they extend over the flaps at the locations of the legs, holding the tubes in their downwardly extended position. When the container is removed from the raised platform, it is supported above the floor by the projecting legs and is shipped to a desired destination in this configuration. When the container reaches its destination, a dolly can be positioned beneath the elevated container and the straps cut, which causes the container to slide down and lowered onto the dolly. The dolly can then be used to easily move the filled container into a store or office or other facility. After the container has been emptied of finished goods, any packaging materials and other trash can be returned to the container for transport out of the building.

Accordingly, one aspect of the present invention is directed to a bulk shipping container capable of being used to transport goods into a building or other facility without requiring the use of pallets or specialized handling equipment. The container comprises opposite side walls, opposite end walls, a bottom wall, and a top wall closed by top closing means. The opposite side walls, the opposite end walls, the bottom wall, and the top wall are foldably joined to one another to form an interior space. A plurality of removable supporting legs extends downwardly from a periphery of the interior space. The lower ends of the plurality of removable supporting legs project a predetermined distance beyond the bottom wall to support the container in an elevated position above a floor so that a dolly or other transport vehicle can be positioned beneath it. The upper ends of the plurality of removable supporting legs are substantially coplanar with the top of the container. The plurality of removable supporting legs are held in their downwardly extended positions by the top closing means, and wherein the container automatically slides down along the plurality of removable supporting legs to a lowered position when the top closing means is opened.

Another aspect of the present invention is directed to a method of using a retractable container in transporting product directly to a point of sale or use without using material handling equipment, the method comprising the steps of providing a retractable container having side walls, end walls, a bottom wall, and a top. Next, placing the retractable container on a raised platform and inserting a plurality of removable supporting legs through the container at each corner thereof so that upper ends of the plurality of removable supporting legs are substantially level with the top of the container and lower ends of the plurality of removable supporting legs project downwardly beyond the bottom of the container. Loading the container with product; applying restraining means to the top of the container to prevent the container from sliding down the plurality of removable supporting legs; removing the loaded container from the raised platform and placing it on a surface so that the plurality of removable supporting legs support the weight of the container in an elevated position above the surface; transporting the container to a desired destination; placing a dolly or other wheeled support beneath the container; disabling the restraining means so that the container slides down through the plurality of removable supporting legs thereby transferring the loaded container onto the dolly; and using the dolly to transport the loaded container into a building or other facility where the product can be conveniently removed.

One further aspect of the present invention is directed to a method of transporting product to a point of sale or use, comprises the steps of providing a container having side walls, end walls, a bottom wall, a top, and a plurality of removable supporting legs extending through the container at each corner thereof so that upper ends of the plurality of removable supporting legs are substantially level with the top of the container and lower ends of the plurality of removable supporting legs project downwardly beyond the bottom of the container; loading the container with product; applying restraining means to the top of the container to prevent the container from sliding down the plurality of removable supporting legs; transporting the container to a desired destination; placing a dolly or other wheeled support beneath the container; disabling the restraining means so that the container slides down through the plurality of removable supporting legs thereby transferring the loaded container onto the dolly; and using the dolly to transport the loaded container into a building or other facility where the product can be conveniently removed.

The container of the invention provides a safe and efficient transport packaging system that greatly reduces the labor, time and expense involved in moving finished product from a transport vehicle or loading dock into a building and offers the retailer a safe and easy way to lower finished goods to the floor.

Using the container of the invention, installers of office furniture are able to bid jobs more competitively and possibly earn more business for the office furniture manufacturer. Rug merchants can place a plurality of rugs in a container according to the invention, which can be lowered onto a dolly for bulk transport of rugs into the store rather than placing them on a pallet for shipment and then transporting them individually into the store as conventionally practiced.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
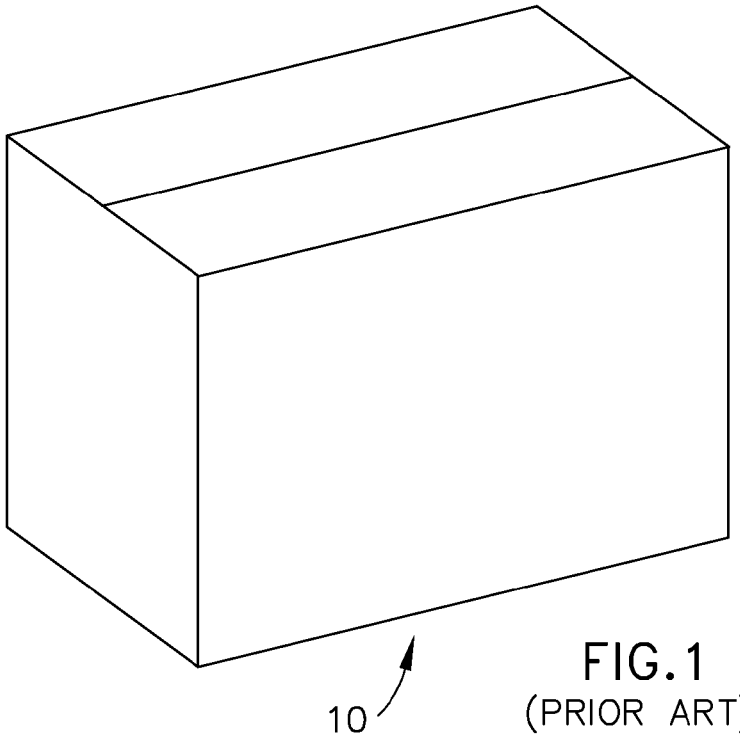
FIG.1 (PRIOR ART)
FIG. 1 is a top perspective view of a prior art container.

A typical prior art container suitable for bulk shipment of goods is indicated generally at 10 in FIG. 1. The container shown is closed at its top by top flaps and comprises a regular slotted container (RSC) made of corrugated paperboard. It is rectangular in shape and rests at its bottom on the floor. Since these bulk containers can exceed four feet in length and three feet in height and width, and can weigh more than 400 pounds, handling of them is difficult and it is generally necessary to place them on a pallet (not shown) for shipping and handling. When circumstances permit, a hand jack or forklift or the like can be used to unload filled containers from the shipping vehicle, and in more limited circumstances to transport the containers into a store or other facility, where finished product is removed and the container then discarded. In many instances, however, handling equipment is not available at the delivery site and/or cannot be used to transport the filled containers in the store or other facility. Under those circumstances, it is necessary to remove the finished product from the container while it remains on the shipping vehicle, and to carry the product piecemeal into the store or other facility.

The container according to the invention, indicated generally at 20 in FIGS. 1-13, provides a simple, economical, and efficient solution to the shortcomings of conventional bulk shipping containers. The invention container preferably is a regular slotted container 21 made of corrugated paperboard, rectangular in shape, with opposite side walls 22*a*, 22*b*, opposite end walls 23*a*, 23*b*, a bottom wall 24, and preferably closed at its top by major and minor top flaps 25*a*, 25*b*, respectively, although a different top closing means such as a separate lid or cover (not shown) could be used if desired. The container is supported in elevated position above the floor by a plurality of supporting legs 26 projecting downwardly from the bottom of the container at the corners. Reinforcing straps 27 and 28 extend around the ends of the container and over the top flaps closely adjacent the support legs to prevent the support legs from punching through the top of the container due to the weight of the filled container.

Vertically spaced horizontal cuts 30 and 31 in the sidewalls of the container at each corner near its top define strips 32 that form guide tabs when they are folded inwardly, and circular openings 33 are formed through the bottom wall 24 of the container in each corner. An elongate tubular support leg 26 is inserted through each guide tab 32 and associated opening 33 so that the top ends of the legs are substantially flush with the top of the container and the bottom ends of the legs project a predetermined distance below the bottom of the container.

Figure 2:
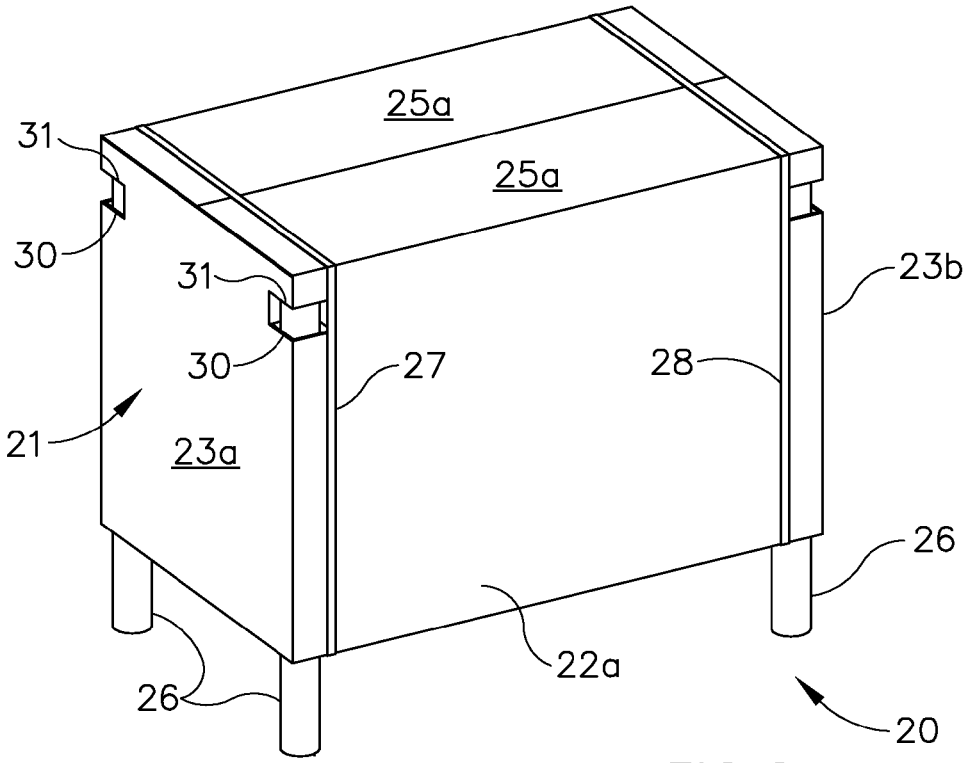
FIG. 2 is a top perspective view of a container according to the invention.
Figure 3:
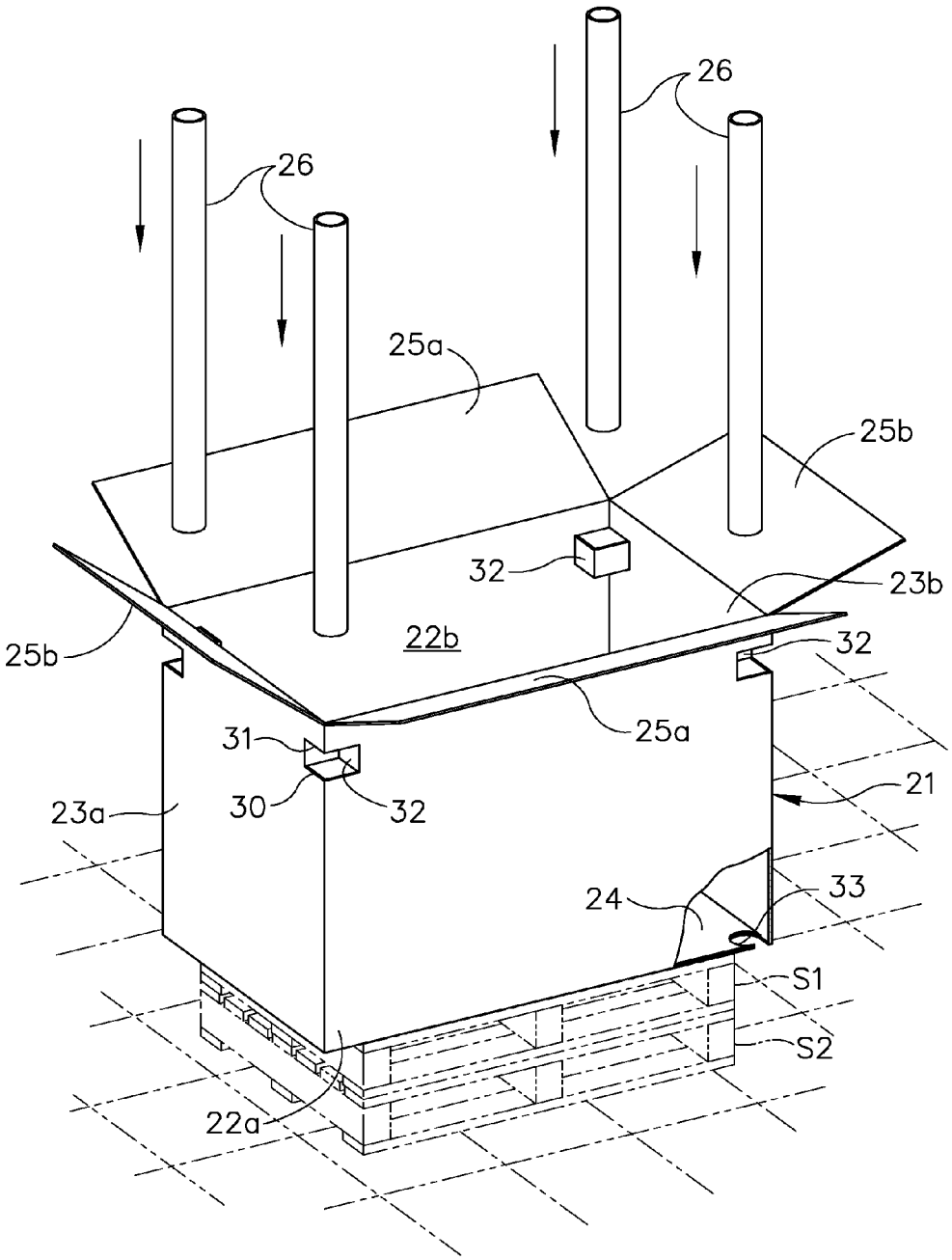
FIG. 3 is an exploded top perspective view of the container, shown supported on a raised platform, with the top flaps open and the plurality of supporting legs being inserted.
Figure 4:
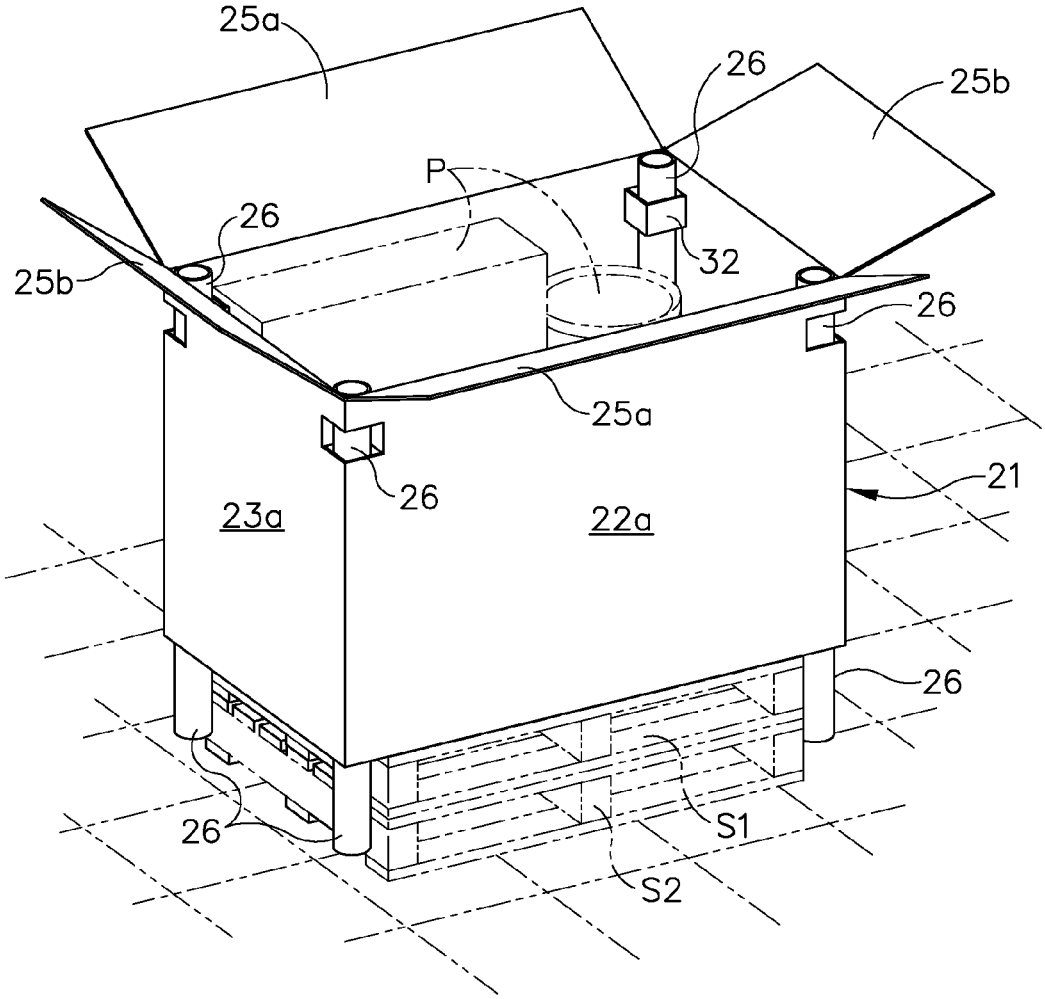
FIG. 4 is a top perspective view of the container, shown with the top flaps open and after the plurality of supporting legs have been inserted and finished product has been loaded into the container.
Figure 5:
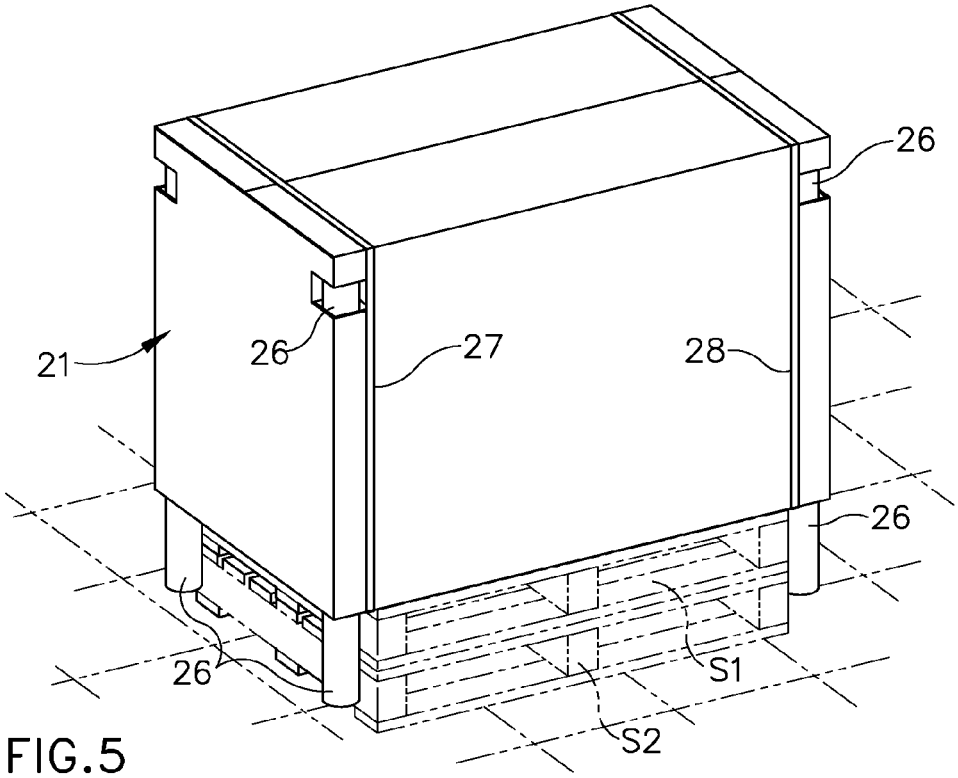
FIG. 5 is a top perspective view of the container, shown still resting on the raised platform, with the top flaps closed and reinforcing bands applied around the ends of the container and over the areas adjacent the locations of the legs.
Figure 6:
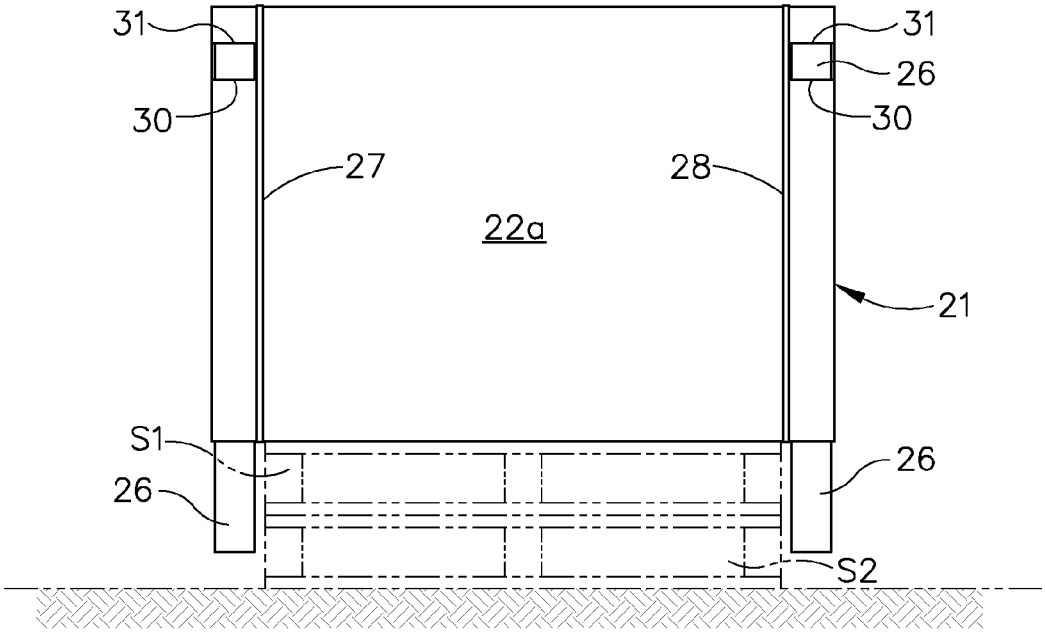
FIG. 6 is a side view in elevation of the container of FIG. 5, showing how the raised platform supports the container in an elevated position, with the legs projecting from the bottom of the container and spaced from the floor.
Figure 7:
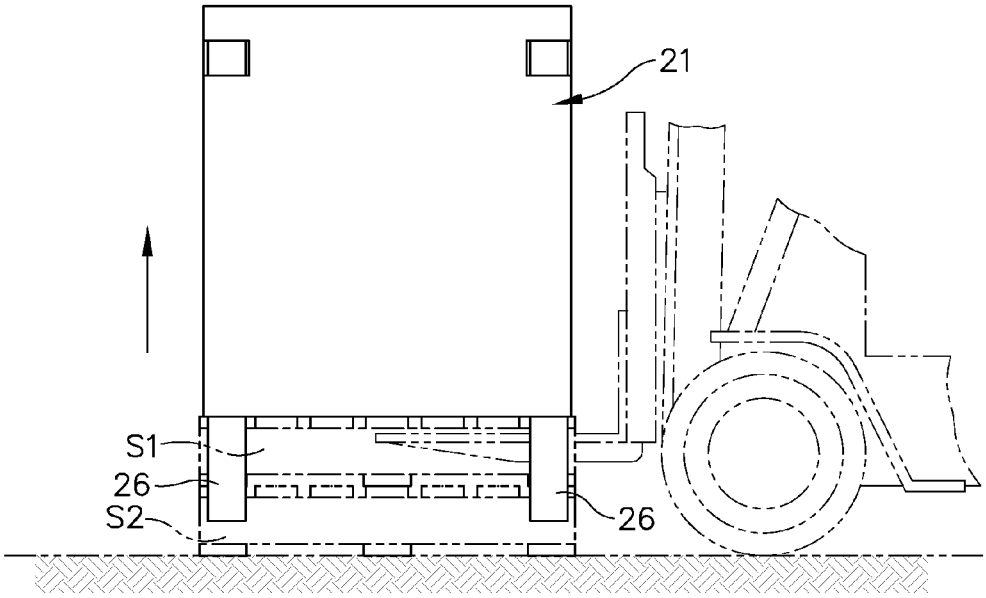
FIGS. 7 through 10 are end views in elevation depicting how the raised platform can be removed so that the container is supported in an elevated position by the projecting legs.
Figure 8:
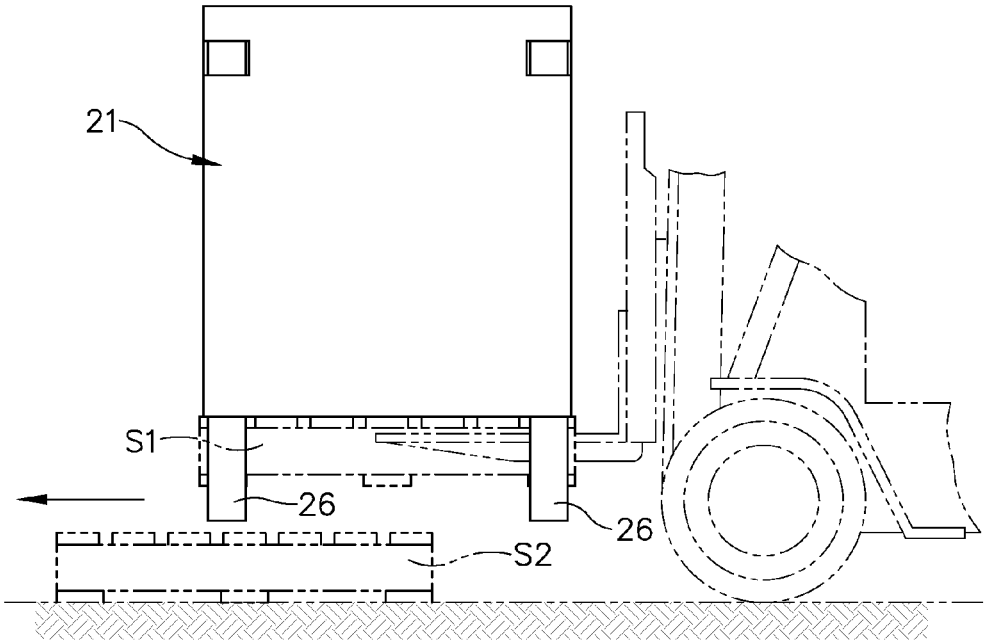
Figure 9:
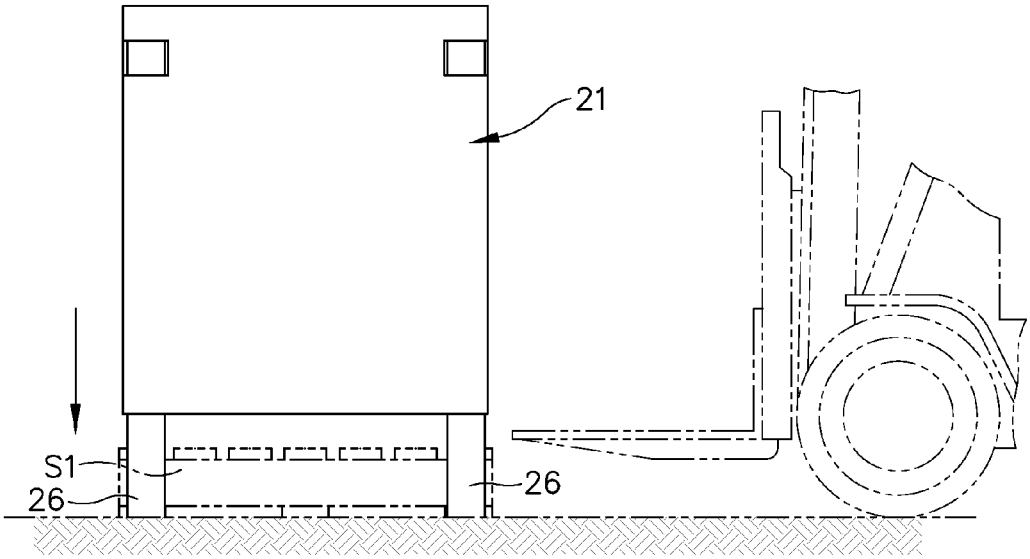
Figure 10:
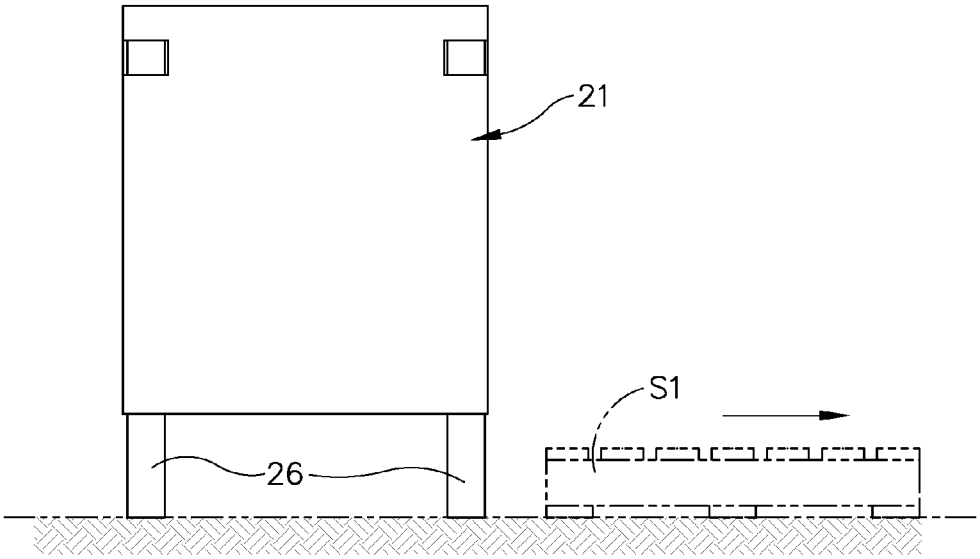

In use, the operator closes the bottom 24 of an empty container 21 and places it on a raised platform comprising, for example, a pair of stacked pallets S1 and S2. The guide tabs 32 are folded inwardly and the plurality of supporting legs 26 are inserted through the guide tabs and the associated openings 33 in the bottom of the container. The length of the legs and the height of the platform are selected so that when the upper ends of the legs are substantially flush with the top of the container their lower ends are spaced above the floor. The container is then filled with product P, the flaps 25*a*, 25*b* folded into closed position, and the straps 27 and 28 applied around the container closely adjacent its ends. A hand jack or forklift or the like is then engaged with the bottom pallet S2 to transport both of the pallets and the loaded container into a shipping vehicle. The pallets are removed by engaging the top pallet S1 and lifting the top pallet and container away from the bottom pallet S2 as shown in FIG. 7. The bottom pallet S2 may then be slid out of the way as shown in FIG. 8. The container and top pallet are then lowered so that the support legs 26 contact the floor. When the lifting equipment is withdrawn, the top pallet S1 is free to be removed since the container is now supported by the legs above the floor and above the pallet S1. The container is then supported by the legs in an elevated position above the floor of the shipping vehicle, as shown in FIGS. 2 and 10.

Figure 11:
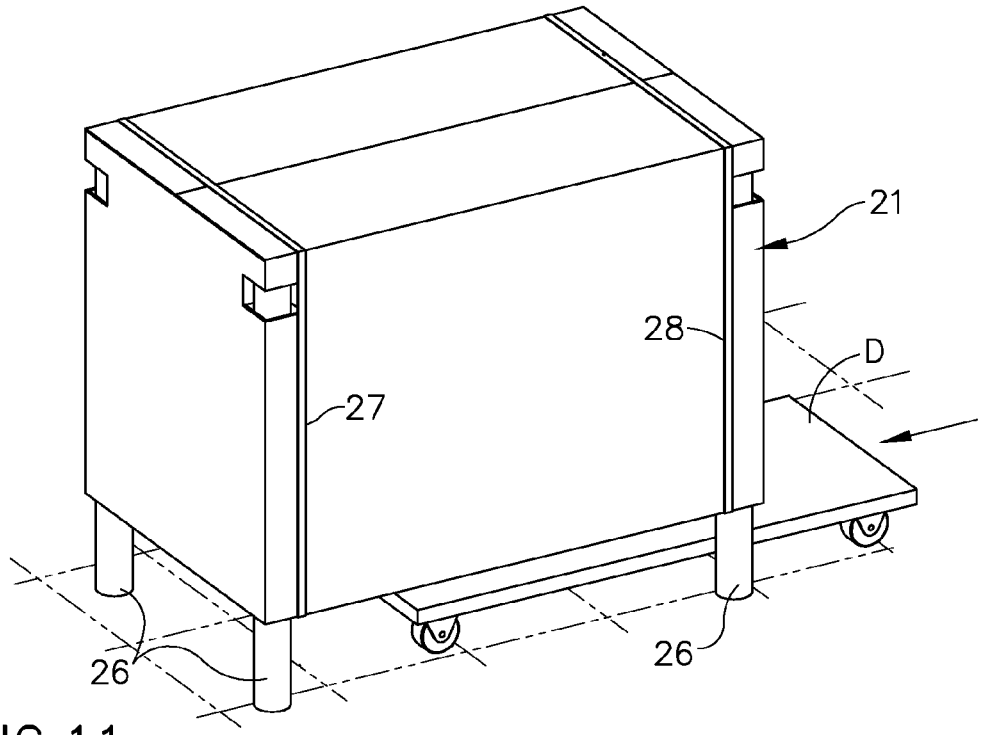
FIG. 11 is a top perspective view depicting a wheeled dolly being inserted beneath the elevated container.
Figure 12:
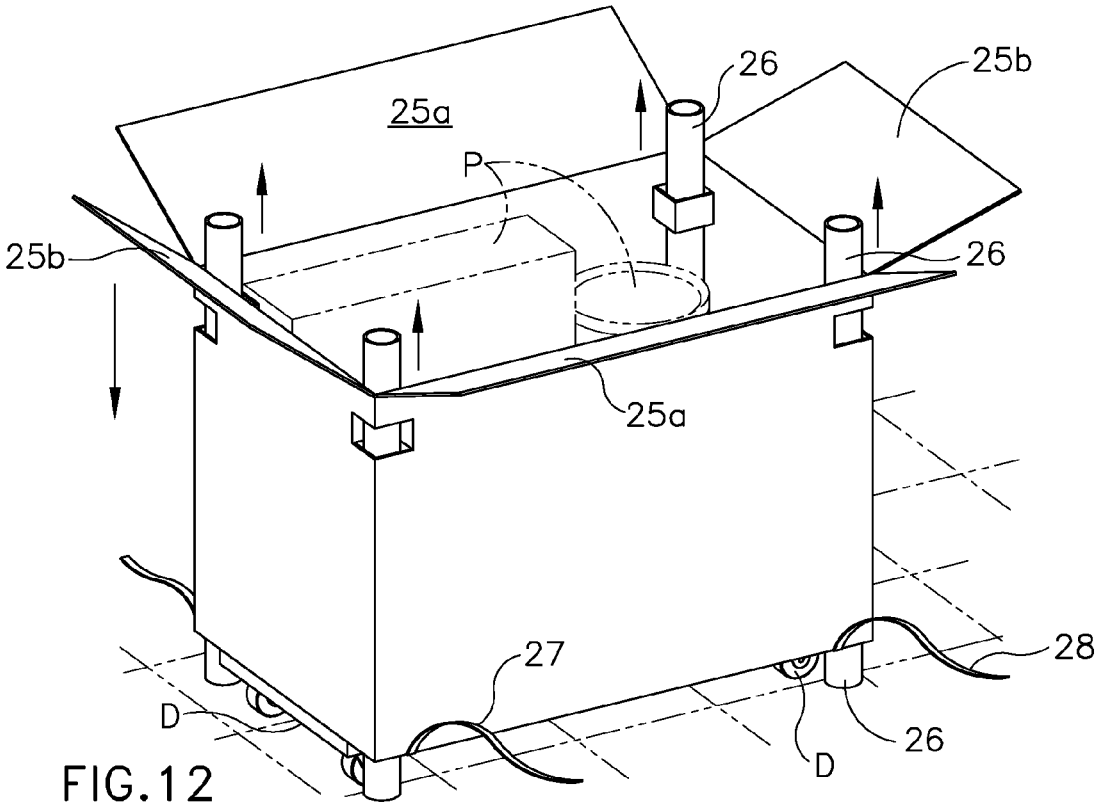
FIG. 12 shows how when the reinforcing straps are cut the weight of the filled container causes it to slide down along the plurality of supporting legs so that they project through the open top, enabling the container to automatically lower to the dolly previously positioned beneath it.
Figure 13:
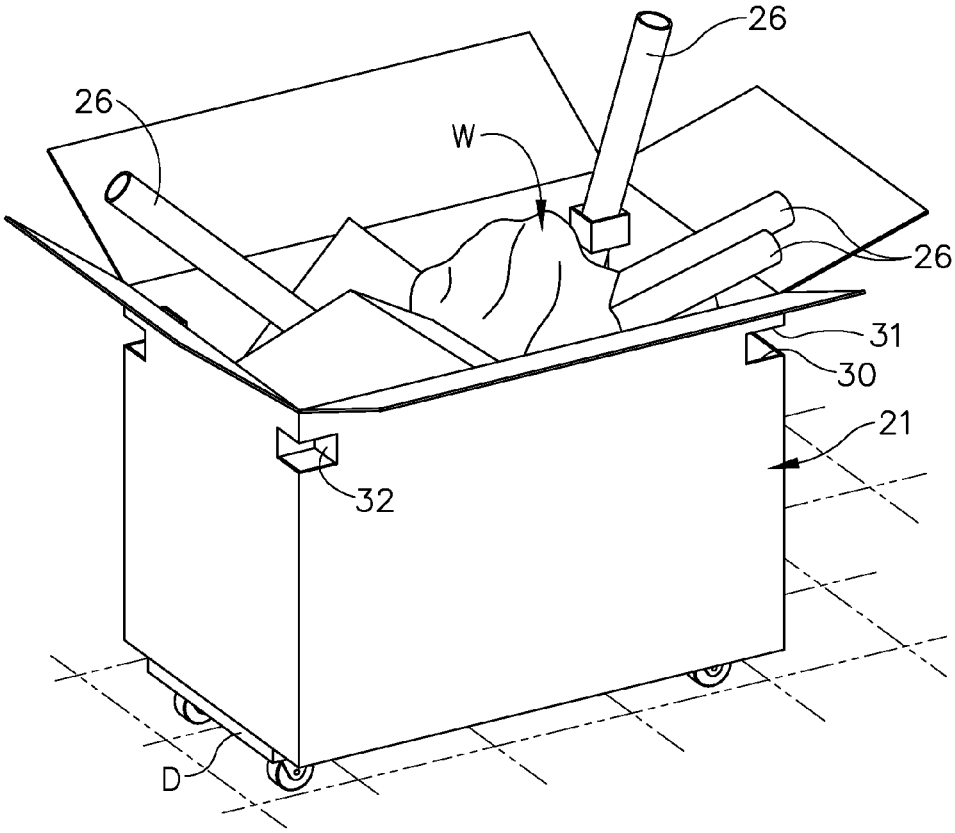
FIG. 13 is a top perspective view of the container used as a waste receptacle for holding packaging materials and other discarded material placed in it after it has been emptied of finished product.

Upon reaching its destination, a dolly D can be positioned beneath the elevated container, as shown in FIG. 11, after which the straps 27 and 28 are cut, allowing the weight of the filled container to cause it to slide down along the legs until it rests on the dolly, with the upper ends of the legs forcing the top flaps open as shown in FIG. 12. The legs may then be removed completely or pulled up enough that they do not interfere with movement of the dolly, which may then be used to transport the filled container into a store or other facility. After all finished product has been removed from the container, it can be used as a waste receptacle to transport used packing materials, the support legs, and other discarded items W out of the building as depicted in FIG. 13.

Figure 14:
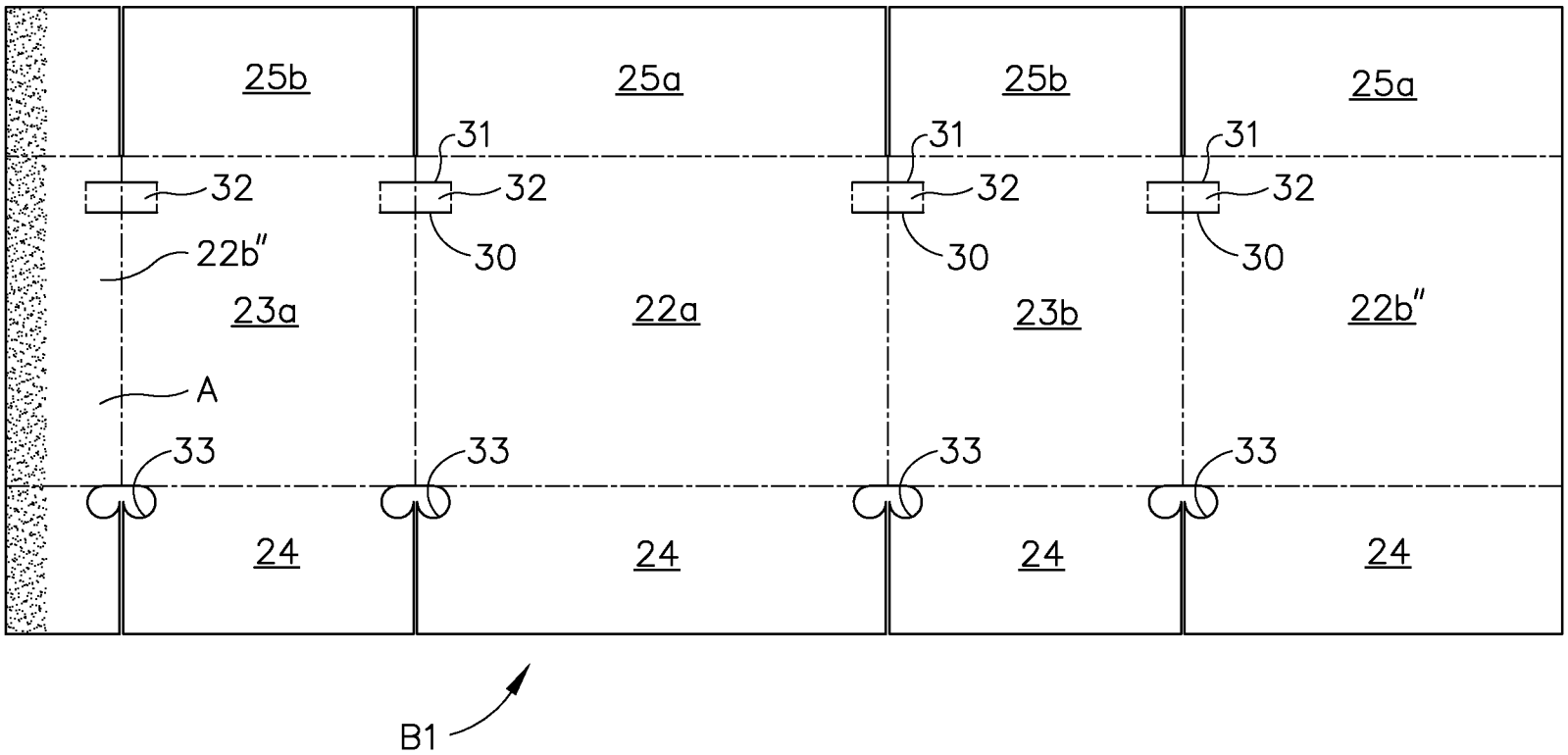
FIG. 14 is a top plan view of a blank for making the container of FIGS. 1-13.

A blank B1 for making the container 21 is shown in FIG. 14. The blank comprises a first rectangular side wall panel 22*a* bordered by two end wall panels 23*a* and 23*b*, and partial side wall panels 22*b*', 22*b*" foldably joined to outer end edges of respective end wall panels 23*a*, 23*b*. The partial side wall panels form glue flaps for securing the blank in a closed tubular configuration, and adhesive is applied to at least one of the glue flaps as indicated by the shaded area A. Major and minor top flap panels 25*a* and 25*b*, respectively, are foldably connected along one edge of the respective side and end wall panels, and bottom-forming bottom flap panels 24 are foldably joined along the opposite edges of the side and end wall panels. The spaced parallel cuts 30 and 31 are made across the folded connection between adjacent side and end wall panels near the edge to which the top flaps are joined, and the openings 33 are formed in adjacent corners of the bottom flap panels 24 at their folded connection with the side and end wall panels.

Figure 15:
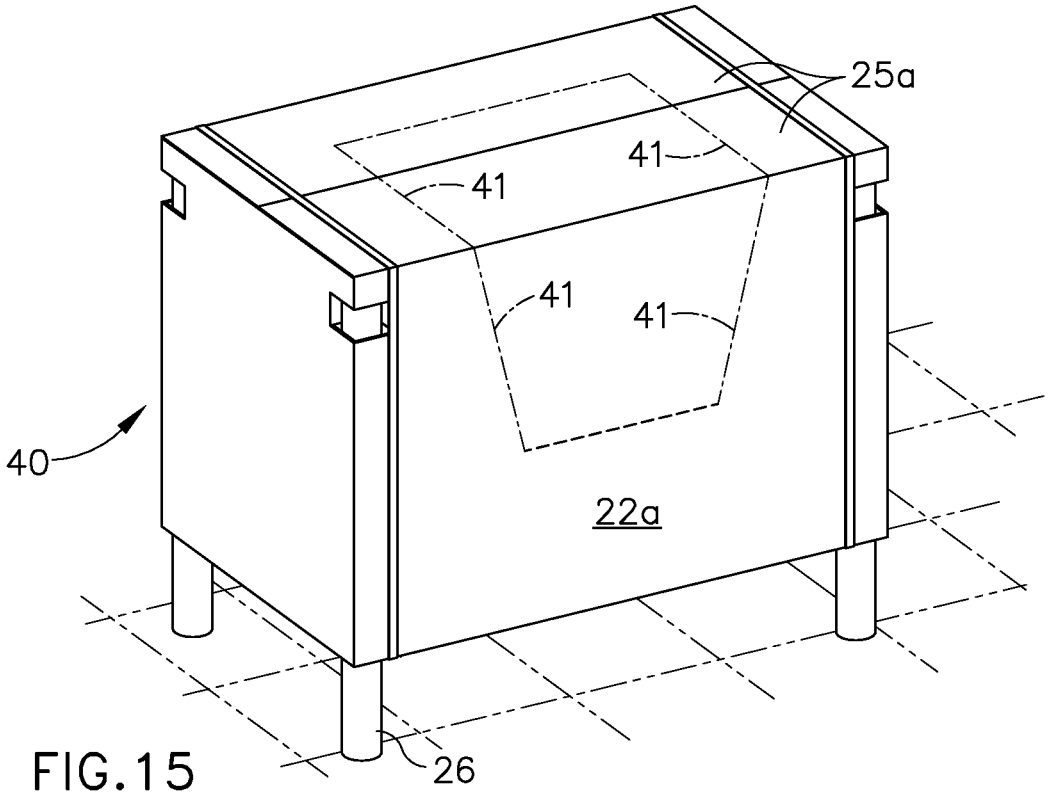
FIG. 15 is a top perspective view of an alternate container according to the invention, wherein a removable panel is provided in a portion of one side wall and the top to facilitate access to the finished product held in the container.
Figure 16:
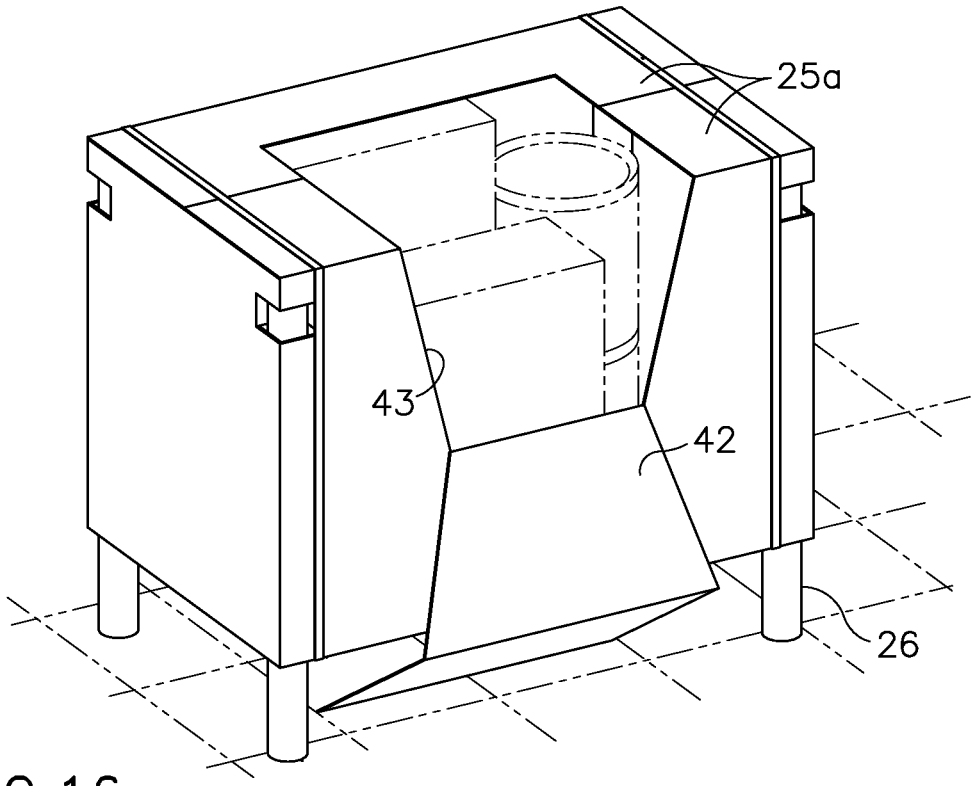
FIG. 16 is a top perspective view of the container of FIG. 15, shown with the panel removed.

An alternate embodiment of the container of the invention is shown at 40 in FIGS. 15 and 16. This embodiment is constructed identically to the previous embodiment and functions in exactly the same way except that a frangible line 41 extending from one side wall 22*a* into the top flaps 25*a* forms a removable panel 42 that may be folded out of the way as shown in FIG. 16 to form a large opening 43 to facilitate access to product P in the container.

Figure 17:
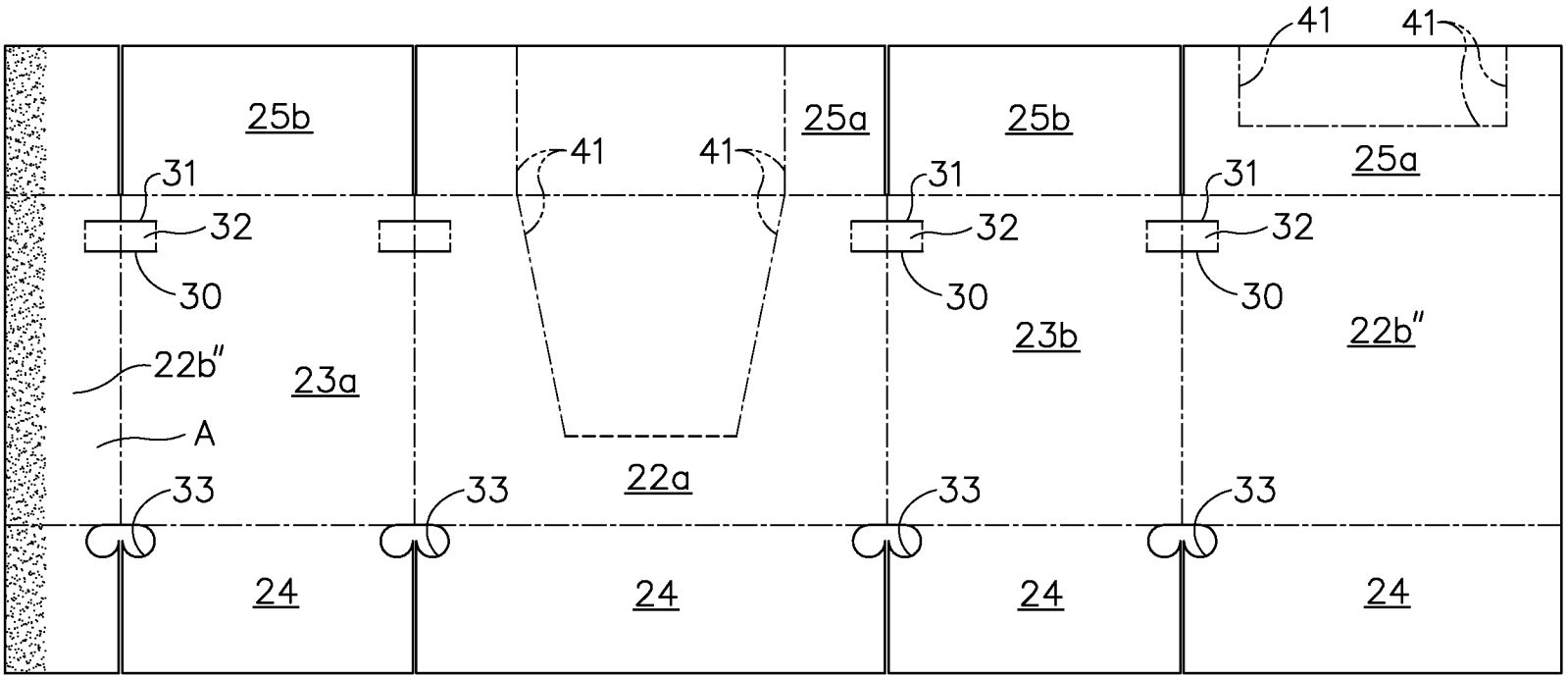
FIG. 17 is a top plan view of a blank for making the container of FIGS. 15 and 16.

A blank B2 for making the container 40 is shown in FIG. 17. It will be noted that the frangible line 41 extends completely across one top flap 25*a* and partially across the opposing top flap 25*a*.

Although the container has been illustrated and described herein as closed at its top by flaps, other means such as a removable lid or cover could be used to close the top of the container. Accordingly, the terminology "top closing means" as used herein is intended to cover both flaps and a separate lid or cover. Functioning of this arrangement would be essentially the same as in the embodiments described herein, except that rather than flaps being forced open when the straps are removed, the cover or lid would be forced open. Also, it is possible that some form of reinforcing means other than the straps could be used to hold the top of the container closed until the reinforcing means is disabled.

For example, it is within the scope of the present invention to hold the tubes in place and suspend the carton in the air using straps with cam locks. This would require additional products like nylon straps, hooks and cam locks. This enhancement could allow for a higher weight limit and also a more controlled descent and accent.

While particular embodiments of the invention have been illustrated and described in detail herein, it should be understood that various changes and modifications may be made in the invention without departing from the spirit and intent of the invention as defined by the appended claims.

What is claimed is:

1. A bulk shipping container capable of being used to transport goods into a building or other facility without requiring the use of pallets or specialized handling equipment, the container comprising:

opposite side walls, opposite end walls, a bottom wall, and a top closed by top closing means, wherein the opposite side walls, the opposite end walls, the bottom wall, and the top closing means are foldably joined to one another to form an interior space, said side walls and said end walls defining a plurality of interior corners, inwardly folded guide tabs formed in each said corner of the container near its top, and said bottom wall having an opening therethrough in each said corner;

removable supporting leg in each said corner, said supporting legs slidably extended through a respective said guide tab and a respective said opening in said bottom wall, said supporting legs each having a length greater than the height of the container and having a lower end extending downwardly through a respective said opening in said bottom wall, said lower ends of said supporting legs projecting a predetermined distance beyond the bottom wall to support the container in an elevated position above a floor so that a dolly or other transport vehicle can be positioned beneath the container between the downwardly extending supporting legs, upper ends of the supporting legs being substantially coplanar with the top of the container and engaged against said top closing means to hold the container in said elevated position, wherein the supporting legs are held in their downwardly extended positions by the top closing means, and wherein the container automatically slides down along the supporting legs to a lowered position when the top closing means is opened.

2. The bulk shipping container of claim 1 wherein:

the top closing means comprises top flaps folded inwardly over the top of said container.

3. The bulk shipping container of claim 1 wherein:

the top closing means includes reinforcing straps applied around the container and over the top flaps adjacent opposite ends of the container in overlying relationship to the upper ends of the supporting legs.

4. The bulk shipping container of claim 1 wherein:

the inwardly folded guide tabs each comprises an inwardly folded tab defined by spaced parallel cuts across respective corners of the container.

5. The bulk shipping container of claim 1 wherein:

the container is made of corrugated paperboard, and the plurality of removable supporting legs comprise tubes made of fiberboard.

6. The bulk shipping container of claim 1 wherein:

a removable panel is formed in the side wall and the top wall of the container for forming an opening to facilitate access to product in the container.

7. A blank for making a container, wherein the blank comprises:

a first side wall panel bordered on opposite side edges by first and second end wall panels each foldably joined along a first edge thereof to the first side wall panel;

second and third partial side wall panels foldably joined to respective end wall panels along edges thereof opposite the first edge;

a bottom flap panel foldably joined along a bottom edge of each of said side wall panel and said end wall panel;

an imperforate top flap panel foldably joined along a top edge of each of said side wall panel and said end wall panel;

circular cutouts in adjacent corners of adjacent said bottom flap panels at their folded connection with respective said side wall panels and end wall panels; and spaced parallel cuts made across the folded connection between adjacent said side wall panels and end wall panels and closely adjacent the folded connection between the top flap panels and respective said side wall panels and end wall panels.

8. A blank for making a container as claimed in claim 7, wherein:

a frangible line is made in one of said side wall panels and an associated said top flap panel, defining a removable panel that forms an access opening into said container when it is removed.

9. In combination, a blank for making a container and supporting legs for use with said blank to hold a container erected from said blank in an elevated position relative to a floor, wherein the blank comprises:

a first side wall panel bordered on opposite side edges by first and second end wall panels each foldably joined along a first edge thereof to the first side wall panel;

second and third partial side wall panels foldably joined to respective end wall panels along edges thereof opposite the first edge;

a bottom flap panel foldably joined along a bottom edge of each of said side wall panel and said end wall panel panels;

an imperforate top flap panel foldably joined along a top edge of each of said side wall panel and said end wall panel panels;

circular cutouts in adjacent corners of adjacent said bottom flap panels at their folded connection with respective said side wall panels and end wall panels; and spaced parallel cuts made across the folded connection between adjacent said side wall panels and end wall panels and closely adjacent the folded connection between the top flap panels and respective said the side wall panels and end wall panels; and said supporting legs comprise tubes each having a length greater than the height of said side wall panels, and a diameter adapted to slidably extend through said circular cutouts in said bottom flap panels.

* * * * *